US006964834B2

(12) United States Patent
Ueda et al.

(10) Patent No.: US 6,964,834 B2
(45) Date of Patent: Nov. 15, 2005

(54) PHOTOSENSITIVE MEMBER HAVING LAYER CONTAINING FLUORINE RESIN PARTICLES AND RESIN FINE PARTICLES AND IMAGE-FORMING METHOD AND APPARATUS USING SAME

(75) Inventors: Hideaki Ueda, Kishiwada (JP); Shino Hirao, Osaka (JP); Mitsutoshi Nakamura, Kawanishi (JP); Mitsuyo Matsumoto, Ibaraki (JP)

(73) Assignee: Minolta Co., Ltd., Osaka (JP)

( * ) Notice: Subject to any disclaimer, the term of this patent is extended or adjusted under 35 U.S.C. 154(b) by 7 days.

(21) Appl. No.: 10/437,965

(22) Filed: May 15, 2003

(65) Prior Publication Data

US 2004/0146315 A1 Jul. 29, 2004

(30) Foreign Application Priority Data

Jan. 27, 2003 (JP) ..... 2003-017204

(51) Int. Cl.[7] ..... G03G 5/05; G03G 5/14

(52) U.S. Cl. ..... 430/59.6; 430/58.05; 430/66; 430/120; 399/159; 399/350

(58) Field of Search ..... 430/66, 120, 59.6, 430/58.05; 399/350, 159

(56) References Cited

U.S. PATENT DOCUMENTS

| | | | | |
|---|---|---|---|---|
| 4,757,349 | A * | 7/1988 | Toshimitsu et al. | 399/350 |
| 5,667,926 | A | 9/1997 | Maruyama et al. | |
| 6,282,400 | B1 | 8/2001 | Aoki et al. | |
| 2002/0119381 | A1 * | 8/2002 | Motohashi et al. | 430/58.05 |
| 2003/0138718 | A1 * | 7/2003 | Yagi et al. | 399/159 |

FOREIGN PATENT DOCUMENTS

| | | |
|---|---|---|
| JP | 62-292476 | 12/1987 |
| JP | 01-223470 | 9/1989 |
| JP | 06-059501 | 3/1994 |
| JP | 06-083108 | 3/1994 |
| JP | 06-095428 | 4/1994 |
| JP | 06-102702 | 4/1994 |
| JP | 07-261450 | 10/1995 |
| JP | 08-069131 | 3/1996 |
| JP | 08-184989 | 7/1996 |
| JP | 08-278659 | 10/1996 |
| JP | 08-314187 | 11/1996 |
| JP | 08-314280 | 11/1996 |
| JP | 10-246980 | 9/1998 |
| JP | 10-301318 | 11/1998 |
| JP | 11-015206 | 1/1999 |
| JP | 11-237800 | 8/1999 |
| JP | 2001-100452 | 4/2001 |
| JP | 2002-31902 | 1/2002 |
| JP | 2002-31903 | 1/2002 |
| JP | 2002-82468 | 3/2002 |

OTHER PUBLICATIONS

Diamond, Arthur S. (ed.) Handbook of Imaging Materials. New York: Marcel–Dekker, Inc. (1991) p. 195.*

* cited by examiner

*Primary Examiner*—Christopher RoDee
(74) *Attorney, Agent, or Firm*—Burns, Doane, Swecker & Mathis LLP

(57) ABSTRACT

The present invention relates to an image-forming method and a image-forming device, wherein a specific photosensitive member, an exposing process and a toner are adopted in combination.

21 Claims, 1 Drawing Sheet

PHOTOSENSITIVE MEMBER HAVING LAYER CONTAINING FLUORINE RESIN PARTICLES AND RESIN FINE PARTICLES AND IMAGE-FORMING METHOD AND APPARATUS USING SAME

This application is based on application(s) No. 2003-017204 filed in Japan, the contents of which are hereby incorporated by reference.

BACKGROUND OF THE INVENTION

1. Field of the Invention

The present invention relates to an image-forming method and an image-forming apparatus to be used for an electrophotographic system.

2. Description of the Related Art

In the image-forming method in an electrophotographic system, an electrostatic latent image is formed on a photosensitive member by an exposure device, the electrostatic latent image is developed by using toner, and the toner image is transferred on to a recording member such as paper and an OHP sheet, and the transferred image is fixed by a heating means or the like to obtain an outputted object.

In recent years, there have been strong demands for high resolution and high gradation in copying machines and laser printers. In order to satisfy these demands, the optical system, transfer speed and the like have been improved. However, in the conventional developing system using toner, characters and images on the resulting outputted object tend to lack sharpness and a sufficient gradation property, resulting in problems of disconnected highlighted portions in a photographic image and damaged shadow portions. For this reason, there has been the necessity of sharpening the particle-size distribution by making the toner particle size smaller.

Conventionally, the toner has been manufactured through a so-called pulverizing method in which, after a pigment such as carbon black has been mixed, fused and kneaded in a thermoplastic resin to be formed into an uniformly dispersed matter, this is pulverized by an appropriate fine pulverizing device into particles having an appropriate particle size required as a toner. In the pulverizing method, the shape of toner becomes indefinite, which is not necessarily appropriate for high-resolution and high-gradation. Since a classifying process is required so as to control the particle-size distribution, the costs become higher, and there is a limitation in efficiency in providing a smaller particle size.

Therefore, in recent years, from the viewpoint of reduction in the manufacturing costs and high image quality, granulation methods in a wet system, typically represented by a suspension polymerizing method and an emulsion dispersing method, which can provide resin fine particles having a small, comparatively uniform particle size, have received much attention in place of the pulverizing method.

In the suspension polymerizing method, a polymer composition having components, such as a polymerizable monomer, a polymerization initiator and a coloring agent, is suspended in a dispersion medium, and polymerized so as to carry out a granulation process. The toner obtained through the suspension polymerizing method provides resin particles after the polymerization that directly have a particle size suitable for toner particles, and the shape thereof has a virtually true spherical shape. The toner manufactured through the suspension polymerizing method is poor in its cleaning property on the photosensitive member, and has difficulty to be sharply controlled regarding the particle size distribution, although it is suitable for preparing high-quality images. In the case when the cleaning property is poor on the photosensitive member, when residual toner on the surface of the photosensitive member is cleaned by using a cleaning blade, toner escape from the blade tends to occur, resulting in filming on the surface of the photosensitive member and the subsequent deteriration in the image quality of the resulting image.

In the emulsion dispersing method, a binder resin and a coloring agent are dissolved or dispersed in an appropriate organic solvent to prepare a colored resin solution. After adding the solution to an aqueous dispersion solution, the resulting solution is stirred hard so as to form droplets in the resin solution, and heated to remove the organic solvent from the droplets so that a granulating process is carried out. With respect to the toner obtained from the emulsion dispersing method, it is possible to obtain toner having a small particle size by properly selecting processing conditions, and also to obtain toner having an indefinite shape; however, it is difficult to sharply control the particle size distribution.

Conventional problems with photosensitive members include a problem with abrasion resistance in which an abrasion occurs in the photosensitive layer due to long-term use, a problem with transferring property in which one portion of a toner image formed on the photosensitive member is not copied onto a copying material to cause an image loss, and the above-mentioned problem with a cleaning property. In particular, upon application of toner having a small particle size that is effectively used for obtaining a high-precision image (images with high resolution and high gradation), the deterioration in the cleaning property becomes serious. Although high resolution and high gradation in the initial image can be achieved, a new problem is raised in which upon continuous printing processes, there is deterioration in the resolution and gradation. In an attempt to prevent such deterioration in the resolution and gradation occurring upon continuous printing processes and to obtain stable and desirable images, it is necessary to improve not only the photosensitive member, but also both of the member and the developer.

SUMMARY OF THE INVENTION

The present invention is to provide an image-forming method and an image-forming apparatus which can easily provide an image having superior resolution and gradation for a long time without causing filming.

The present invention is to provide an image-forming method and an image-forming apparatus which can easily provide an image that has superior resolution and gradation and is free from irregularities and image-loss portions for a long time without causing filming.

In the present specification, irregularities refer to a coarse granular state with respect to texture of an image caused by particulate noise that occur in both of the image portion and non-image portion, and are inherently different from phenomena at the time of deterioration in the resolution and gradation that cause damaged edges in an image itself and deterioration in the reproducibility in the image density.

The above objects can be achieved by an image-forming method and a image-forming device, wherein a specific photosensitive member, an exposing process and a toner are adopted in combination.

EMBODIMENTS OF THE PRESENT INVENTION

Figure 1:
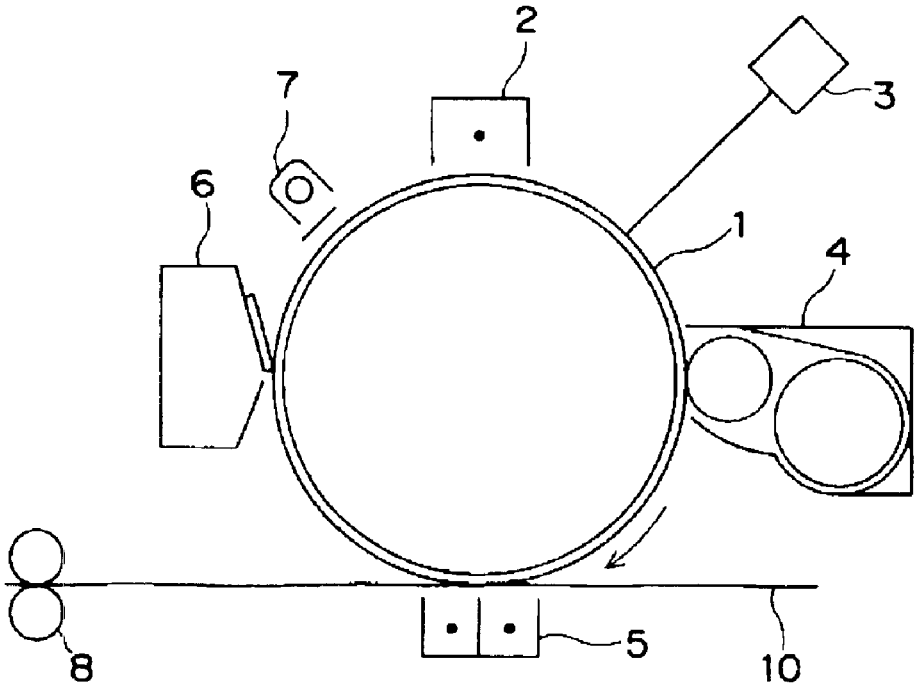
FIG. 1 is a schematic explanatory drawing that shows one example of an apparatus in which an image-forming method of the present invention is carried out.

The present invention provides an image-forming method and an image-forming device wherein a specific photosensitive member, an exposing process and a toner are adopted in combination.

In more detail, the present invention provides an image-forming method, in which a digital image exposing process having a recording dot density of not less than 400 dots/inch is carried out on a function divided photosensitive member whose uppermost-surface charge transporting layer contains fluorine-containing resin fine particles, to form an electrostatic latent image thereon, and the electrostatic latent image is developed by using a toner that has a volume-average particle size of 2 to 5.5 $\mu$m, with a ratio of content of particles having a particle size of not more than 1 $\mu$m being set to not more than 1.0 volume %.

The present invention also provides an image-forming apparatus which is provided with a function divided photosensitive member whose uppermost-surface charge transporting layer contains fluorine-containing resin fine particles, a digital image exposing device having a recording dot density of not less than 400 dots/inch, and a toner that has a volume-average particle size of 2 to 5.5 $\mu$m, with a ratio of content of particles having a particle size of not more than 1 $\mu$m being set to not more than 1.0 volume %.

The following description will discuss embodiments of the present invention in detail.

First, referring to FIG. 1, the following description will discuss the outline of an image-forming apparatus in which an image-forming method of the present invention and an image-forming device using the method are adopted, in detail. FIG. 1 is a schematic drawing that shows an essential structure of one embodiment of the image-forming apparatus of the present invention. The apparatus is at least provided with a photosensitive member 1, an exposing device 3 and a toner, and, preferably, has a cleaning device 6. In the apparatus, the toner is housed in the developing device 4, and in general, a charging device 2, a transferring device 5, a light charge-eliminating device 7 and a fixing device 8 are further installed therein.

When forming an image, the photosensitive member 1 is first rotated so that the surface of the photosensitive member is charged by a charging device 2 such as a corona charger. Here, with respect to the system speed at which the photosensitive member 1 is rotated so as to carry out an image-forming process, although not particularly limited, it is preferably set to 300 mm to 700 mm/sec in the present invention so as to carry out an image-forming process at high speeds.

An exposing process in a digital system is carried out on the surface of the photosensitive member 1 charged as described above by using an exposing device 3 such as a laser, an LED and a PLDT shutter so that an electrostatic latent image is formed on the surface of the photosensitive member 1. In the present invention, from the viewpoint of high resolution and high gradation, the exposing device 3 is preferably provided with a recording dot density of not less than 400 dots/inch, preferably 400 to 1200 dots/inch. If the recording dot density is too small, it is not possible to obtain images having superior resolution and gradation from the initial stage. From the viewpoint of prices and light amount, an exposing device using a laser having an oscillating wavelength of 600 to 850 nm is preferably adopted.

Then, a developer (toner) is supplied from the developing device 4 to the surface of the photosensitive member 1 with an electrostatic latent image formed thereon so that a toner image corresponding to the electrostatic latent image is formed on the surface of the photosensitive member 1. With respect to the developer housed in the above-mentioned developing device 4, one-component developer using only the toner, or two-component developer using toner and carrier in a mixed manner, may be used. With respect to the developing process by the above-mentioned developing device 4, either of an inversion developing process and a regular developing process may be used.

The toner image, formed on the surface of the photosensitive member 1 as described above, is transferred onto a recording member 10 such as recording paper through a transferring device 5, so that the toner image, thus transferred on the recording member, is fixed on the recording member by the fixing device 8.

After the toner image has been transferred on the recording member as described above, residual toner on the surface of the photosensitive member 1 is removed by the cleaning device 6. In the present invention, the cleaning device is not necessarily installed. This is because the image-forming method and the image-forming device of the present invention are superior in the transferring property (transferring efficiency), and hardly require any cleaning operations of the photosensitive member. When the cleaning device 6 is installed, the cleaning device may be a cleaning blade, a cleaning brush, a cleaning roller and the like. From the viewpoint of compactness of the device and manufacturing costs thereof, a cleaning blade is preferably used. Since the toner to be used in the present invention, which will be described later, has a small particle-size, the application of the cleaning blade makes it difficult to carry out the cleaning process in the case of a conventional apparatus. However, since the image-forming method and the image-forming device of the present invention are superior in the transferring property (transferring efficiency) as described above, such a problem is not raised. From the viewpoint of further improvements in the cleaning property, a lubricating agent, which may be applied to the surface or the like of the toner particles which will be described later, and/or fluorine-containing resin fine particles to be contained in the charge-transporting layer of the photosensitive member may be kneaded into the blade itself or may be added to the surface of the blade.

After the surface of the photosensitive member has been cleaned, light is applied onto the surface of the photosensitive member 1 from the light charge-eliminating device 7 such as an LED and a cold cathode-ray tube so that residual electric potential on the surface of the photosensitive member 1 is removed.

The image-forming method and the image-forming apparatus of the present invention are not intended to be limited by the above-mentioned single example. For example, the apparatus shown in FIG. 1 has only one developing device. However, a plurality of developing devices having toners of different colors and an intermediate transferring member, which is used for temporarily holding the toner image prior to transferring a toner image from the photosensitive member onto a recording member, may be installed.

The toner to be used in the image-forming method and the image-forming apparatus of the present invention is set to have toner particles having a volume average particle size of 2 to 5.5 $\mu$m, preferably in a range of not less than 3 $\mu$m to less than 5 $\mu$m, with the rate of toner particles having a particle size of not more than 1 $\mu$m being set to not more than 1.0 volume %, preferably not more than 0.5 volume %, in the entire toner particles. The volume-average particle size of less than 2 μm causes a problem with the fluidity. The volume-average particle size of greater than 5.5 μm causes deterioration in the gradation and resolution from the initial stage during continuous printing operations. When particles having a particle size of not more than become greater than 1.0 volume %, problems are raised in the fluidity, scattering and cleaning property. Even when comparatively good resolution and gradation are provided in the initial stage, it is not possible to maintain superior gradation and resolution for a long time during continuous printing operations. Toner particles tend to be taken into the human body, resulting in a problem with safety.

In the toner of the present invention, from the viewpoint of further improvements in the gradation, resolution, fluidity and transferring efficiency, the rate of toner particles having a particle size of not less than 9 μm is preferably set to not more than 1.0 volume % in the entire toner particles.

The toner particles of the toner to be used in the present invention may be manufactured by any method as long as the above-mentioned particle-size distribution is achieved (that is, volume-average particle size "the rate of toner particles having a particle size of not more than 1 μm in the entire toner particles" and if desired, "the rate of toner particles having a particle size of not less than 9 μm in the entire toner particles"). For example, either of toner particles manufactured by a pulverizing method and those manufactured by a polymerization method may be used; however, preferably, toner particles manufactured by a polymerization method are used. In the case of the pulverizing method, at least a coloring agent is mixed in a thermoplastic binder resin, and fused and kneaded to obtain a uniformly dispersed matter, and the dispersed matter is pulverized by an appropriate fine pulverizing device to particles having a necessary particle size as toner particles, and classified. However, in an attempt to achieve the particle size distribution of the present invention by using such a pulverizing method, very complex classifying processes are required, resulting in a reduction in the yield. In the polymerization method, simultaneously as the synthesizing process of the resin itself, the toner-forming process is carried out. Thus, it becomes possible to greatly reduce the manufacturing energy in comparison with the pulverizing method.

The polymerization method includes a suspension polymerization method, emulsion polymerizing coagulation method and dispersion polymerization method, and any of these method may be used. However, in particular, the emulsion polymerizing coagulation method is preferably used. In the suspension polymerization method, a polymerizing composition containing components, such as a polymerizable monomer, a polymerization initiator and a coloring agent, is suspended in a dispersion medium, and polymerized to form toner particles. In the suspension polymerization method, in order to achieve the particle size distribution of the present invention, a further complex manufacturing method is required, and a classifying process may be added thereto. In accordance with the emulsion polymerizing coagulation method, it is possible to easily form toner particles having a small particle size, which achieves the particle size distribution of the present invention, without the necessity of any classifying processes; thus, it becomes possible to sufficiently achieve images with high resolution, high gradation and high image quality. It is also possible to provide a good yield.

The following description will discuss a case in which toner particles that achieve the particle-size distribution of the present invention are manufactured by using the emulsion polymerizing coagulation method, in detail.

In the emulsion polymerizing coagulation method, first, by emulsion-polymerizing a polymerizable monomer, resin fine particles having a volume-average particle size of approximately 50 to 500 nm are formed, and the resulting resin fine particles are subjected to an aggregating process or the like with at least a coloring agent so that toner particles are formed.

More specifically, for example, either of the following method (I) or (II) may be adopted.

Method (I): a polymerizing composition containing a polymerizable monomer is dispersed in a dispersion medium, and emulsion-polymerized so that resin fine particles are formed. Next, the resin fine particles and additives such as a coloring agent, a charge-controlling agent, magnetic particles and a release agent are emulsion-dispersed, and aggregated, adhered and fused with each other. The charge-controlling agent, magnetic particles and release agent may be preliminarily contained in the polymerizing composition in an independent manner respectively.

Method (II): after additives such as a charge-controlling agent and a release agent have been preliminarily dispersed in a dispersion medium, a polymerizing composition containing a polymerizable monomer is dispersed in the dispersion medium, and subjected to a seed-emulsion-polymerization to form resin fine particles. Next, the resin fine particles, a coloring agent and magnetic particles are emulsion-dispersed, and aggregated, adhered and fused with each other.

Method (I) and method (II) are the same except that the time of addition of the additives such as the charge-controlling agent and the release agent is different and that there is a difference as to whether or not the seed is consequently present at the time of the emulsion-polymerizing process; therefore, the following explanation for the emulsion polymerizing coagulation method is applicable to either of method (I) and method (II), unless otherwise specified.

In method (I) and method (II), the emulsion polymerizing and seed-emulsion-polymerizing processes may be carried out in multiple stages to form resin fine particles. In other words, the polymerizing composition is emulsion-polymerized in a dispersion medium in the presence of a seed or in the absence thereof, and after the resulting resin fine particle dispersion solution has been mixed with a dispersion medium separately prepared, a polymerizing composition, prepared in a separated manner, is mixed and stirred therewith to carry out a seed-emulsion polymerizing process. These operations may be carried out repeatedly. An emuision-polymerizing process and/or a seed-emulsion-polymerizing process (hereinafter, referred to as "emulsion-polymerizing process and the like") are carried out in multiple stages so that it is possible to control the thermal characteristics of the resin.

In the case when the emulsion-polymerizing process and the like are carried out in multiple stages, normally the total three emulsion-polymerizing processes and the like are carried out. In the case when the emulsion-polymerizing processes and the like are carried out in multiple stages with the release agent, charge-controlling agent and magnetic particles, in particular, the release agent, being added to the polymerizing composition, it is not necessary to add the release agent and the like to all the polymerizing compositions to be used in all the emulsion-polymerizing processes and the like. When the total three emulsion-polymerizing processes and the like are carried out, it is preferable to add the release agent and the like to the polymerizing composition to be used in the second emulsion-polymerizing process.

With respect to the polymerizable monomer composing the polymerizing composition, examples thereof include: styrene-based monomers such as styrene, methyl styrene, methoxy styrene, methyl styrene, propyl styrene, butyl styrene, phenyl styrene and chlorostyrene; acrylate- or methacrylate-based monomers such as methyl acrylate, ethyl acrylate, propyl acrylate, butyl acrylate, pentyl acrylate, dodecyl acrylate, stearyl acrylate, ethylhexyl acrylate, lauryl acrylate, methyl methacrylate, ethyl methacrylate, propyl methacrylate, butyl methacrylate, pentyl methacrylate, dodecyl methacrylate, stearyl methacrylate, ethylhexyl methacrylate and lauryl methacrylate. Among these monomers, in particular, styrene and butyl(meth)acrylate are preferably used.

With respect to the polymerizable monomer, a third vinyl compound may be used. Examples of the third vinyl compound include acid monomers such as those of acrylic acid, methacrylic acid, maleic anhydride and vinyl acetate, acrylic amide, methacrylic amide, acrylonitrile, ethylene, propylene, butylene, vinyl chloride, N-vinyl pyrrolidone and butadiene.

The rate of use of the polymerizable monomers (co-polymerization ratio) is preferably determined so as to set the glass transition temperature of the resulting polymer to not more than 80° C., preferably 40° C. to 80° C., more preferably 40° C. to 70° C.

In the case when styrene and alkyl (meth)acrylate are used, the rate of use is normally selected from a range of weight ratio of 20/80 to 90/10. For example, in the case of styrene and butyl acrylate, the weight ratio is preferably set in a range of 40/60 to 90/10, more preferably in a range of 60/40 to 80/20. The rate of use of the third vinyl compound with respect to the entire polymerizable monomer is normally set to not more than 20% by weight, preferably 10% by weight or less.

In the present invention, a polyfunctional vinyl compound may be further used as the polymerizable monomer. With respect to the polyfunctional vinyl compound, examples thereof include: diacrylate such as ethylene glycol, propylene glycol, butylene glycol and hexylene glycol, dimethacrylate, such as ethylene glycol, propylene glycol, butylene glycol and hexylene glycol, diacrylate and triacrylate of tertiary or more alcohol, such as divinyl benzene, pentaerythritol and trimethylol propane, and dimethacrylate and trimethacrylate of tertiary or more alcohol, such as pentaerythritol and trimethylol propane. The rate of use of the polyfunctional vinyl compound with respect to the entire polymerizable monomer is normally set to 0.001 to 5% by weight, preferably 0.003 to 2% by weight, more preferably 0.01 to 1% by weight. When the copolymerization ratio of the polyfunctional vinyl compound is too high, the resulting problems are deterioration of the fixing property and deterioration in the transparency in an image on the OHP.

The co-polymerization of the polyfunctional vinyl compound generates a gel component that is insoluble to tetrahydrofran, and the rate of the gel component in the entire polymer is normally set to not more than 40% by weight, preferably 20% by weight.

With respect to the maximum peak molecular weight of the polymer (resin) in toner particles obtained by the above-mentioned polymerization of the polymerizable monomer, it is normally set to 7,000 to 200,000, preferably 20,000 to 150,000, more preferably 30,000 to 100,000, on a polystyrene conversion basis by the use of GPC (gel permeation chromatography). Two or more peaks of the molecular weight may exist; however, a single peak is preferable. The peak of the molecular weight distribution may have a shoulder portion, or may have a tailing portion on the high molecular weight side.

Normally, a chain transfer agent is added to the polymerizing composition together with the above-mentioned polymerizable monomer so as to control the molecular weight distribution of a polymer at the time of polymerization. For example, when the emulsion-polymerizing processes and the like are carried out in three stages, the chain transfer agent may be added to the polymerizing composition at each of the stages.

With respect to the chain transfer agent, examples thereof include: alkyl mercaptan, mercapto propionate, mercapto octanoate, mercapto glycolate and disulfide compounds.

More specifically, examples thereof include: alkyl mercaptan, such as n-dodecyl mercaptan, t-dodecyl mercaptan, n-octyl mercaptan, n-stearyl mercaptan and n-hexyl mercaptan; mercapto propionate, such as n-octyl mercapto propionate and 2-ethylhexyl mercapto propionate; mercapto octanoate such as 2-mercapto ethyl octanoate; mercapto glycolate, such as ethyleneglycol bismercapto glycolate and 2-ethylhexyl mercapto glycolate; disulfide compound such as diisopropyl xanthogen disulfide.

With respect to these chain transfer agents, commercially available products and synthesized products may be used.

The amount of addition of the chain transfer agent, which differs depending on desired molecular weights and molecular weight distributions, is specifically set to 0.1 to 7% by weight with respect to the weight of the polymerizable monomer.

Normally, a polymerization initiator and a dispersion stabilizer are added to the dispersion medium.

With respect to the polymerization initiator, water-soluble polymerization initiators are preferably used. Examples thereof include: peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetraphosphor hydroperoxide, 1-phenyl-2-methylpropyl-1-hydroperoxide, tert-butylhydroperoxide pertriphenyl acetate, tert-butyl performate, tert-butyl peracetate, tert-butyl perbenzoate, tert-butyl perphenyl acetate, tert-butyl permethoxyacetate, tert-butyl per-N-(3-tolyl)palmitic acid; azo compounds such as 2,2'-azobispropane, 2,2'-dichloro-2,2'-azobispropane, 1,1'-azo(methylethyl)diacetate, 2,2'-azobis(2-amidinopropane) hydrochloride, 2,2'-azobis-(2-amidinopropane) nitrate, 2,2'-azobisisobutane, 2,2'-azobisisobutyl amine, 2,2'-azobisisobutylonitrile, 2,2'-azobis-2-methyl methyl propionate, 2,2'-dichloro-2,2'-azobisbutane, 2,2'-azobis-2-methylbutylonitrile, 2,2'-azobisisodimethyl lactate, 1,1'-azobis (1-methylbutylonitrile-3-sodium sulfonate), 2-(4-methylphenylazo)-2-methylmalonodinitrile, 4,4'-azobis-4-cyanovalerate, 3,5-dihydroxymethylphenylazo-2-methylmalonodinitrile, 2-(4-bromophenylazo)-2-allylmalonodinitrile, 2,2'-azobis-2-methylvaleronitrile, 4,4'-azobis-4-cyanodimethylvalerate, 2,2'-azobis-2,4-dimethylvaleronitrile, 1,1'-azobiscyclohexane nitrile, 2,2'-azobis-2-propylbutylonitrile, 1,1'-azobis-1-chlorophenyl ethane, 1,1'-azobis-1-cyclohexane carbonitrile, 1,1'-azobiscyclohexane nitrile, 2,2'-azobis-2-propylbutylonitrile, 1,1'-azobis-1-chlorophenyl ethane, 1,1'-azobis-1-cyclohexane carbonitrile, 1,1'-azobis-1-cycloheptane carbonitrile, 1,1'-azobis-1-phenyl ethane, 1,1'-azobis cumene, 4-nitrophenylazobenzyl cyanoethyl acetate, phenylazodiphenyl methane, phenylazotriphenyl methane, 4-nitrophenylazotriphenyl methane, 1,1'-azobis-1,2-diphenyl ethane, poly(bisphenol A-4,4'-azobis-4-cyano pentanoate) and poly(tetraethyleneglycol-2,2'-azobisisobutylate); 1,4-bis(pentaethylene)-2-tetracene, 1,4-dimethoxycarbonyl-1,4-diphenyl-2-tetracene, etc.

The dispersion stabilizer has a function for preventing droplets dispersed in the dispersion medium from integrally aggregating. With respect to the dispersion stabilizer, a publicly known surfactant may be used; and any compound selected from the group consisting of a cationic surfactant, an anionic surfactant and a nonionic surfactant may be used. Two or more kinds of these surfactants may be used in combination.

Examples of the cationic surfactant include: dodecyl ammonium chloride, dodecyl ammonium bromide, dodecyl trimethyl ammonium bromide, dodecyl pyridinium chloride, dodecyl pyridinium bromide and hexadecyl trimethyl ammonium bromide. Examples of the anionic surfactant include fatty acid soap such as sodium stearate and sodium dodecanate, dodecylsodium sulfate and sodium dodecylbenzene sulfonate. Examples of the nonionic surfactant include: dodecylpolyoxyethylene ether, hexadecylpolyoxyethylene ether, nonylphenylpolyoxyethylene ether, laurylpolyoxyethylene ether, sorbitan monooleate polyoxyethylene ether, styrylphenylpolyoxyethylene ether, and monodecanoyl sucrate. Among these surfactants, an anionic surfactant and/or a nonionic surfactant are preferably used.

The dispersion stabilizer may be additionally added during polymerization and upon completion of the polymerization. Such a re-addition of the dispersion stabilizer effectively prevents the dispersed droplets from integrally aggregating to each other, or makes it possible to prevent the granulated resin fine particles from aggregating.

After the resin fine particles have been formed, the resin fine particle dispersion solution, obtained through the above-mentioned polymerization, and one or more dispersion solutions in which at least a coloring agent (if necessary, release agent, charge-controlling agent, magnetic particles, etc.) is dispersed are mixed and stirred to be aggregated, and during this process, heat is applied thereto so as to be adhered, and after adhered particles between resin fine particles and at least the coloring agent have been formed (aggregation-adhering processes), the entire dispersion system is further heated so that the adhered particles are fused to each other to form toner particles (fusing process); alternatively, the resin fine particle dispersion solution and a dispersion solution in which at least a coloring agent is dispersed are mixed and stirred to be aggregated, so that, after aggregated particles between the resin fine particles and at least coloring agent have been formed (aggregation process), the entire dispersion system is heated to join and fuse the aggregated particles; thus toner particles may be formed (adhering-fusing-processes). In the present invention, from the viewpoint of easily obtaining a toner in which the above-mentioned particle-size distribution has been achieved, the former method is preferably adopted.

In the case of the latter method in which, after resin fine particles and the like have been aggregated at a low temperature, the adhering and fusing processes are carried out simultaneously, it becomes difficult to precisely achieve the above-mentioned "rate of toner particles having a particle size of not more than 1 $\mu$m in the entire toner particles". In other words, in the latter method, since the adhering and fusing processes are not carried out simultaneously with the aggregating process, a small-particle-size component fails to form a particle size that is sufficient as toner particles, resulting in a board particle-size distribution in the aggregating process. Therefore, even when these are fused at a high temperature, it is not possible to control the distribution sharply.

In the present specification, the term "aggregation" is used under the concept that the resin fine particles and the coloring agent particles and the like simply adhere to each other. So-called hetero aggregation particles (group) are formed through "aggregation" in which, although the constituent particles are made in contact with each other, no adhered particles are formed through fusing among the resin fine particles. The particle group that is formed through such "aggregation" is simply referred to as "aggregation particles". By controlling "aggregation", it is possible to control the particle-size distribution of the toner particles.

The term "adhering" is used under the concept that a joint is formed through melting and fusing processes of the resin fine particle and the like at one portion on the interface between the respective constituent particles in the aggregated particles. Here, a group of particles that are subjected to such "adhering" are referred to as "adhered particles".

The term "fusing" is used under the concept that the constituent particles of the adhered particles are integrally joined through melting and fusing processes of the resin fine particles and the like to form one particle as an application and handling unit. A group of particles that are subjected to such "fusing" are referred to as "fused particles".

The following description will explain the former method unless otherwise specified.

In the "aggregation-fusing processes", upon aggregation, a flocculating agent may be added in an attempt to stabilize the aggregated particles and control the particle-size distribution of the toner particles.

With respect to the flocculating agent, an ionic surfactant having a polarity different from that of the resin fine particles, a nonionic surfactant and a compound having a charge of not less than monovalent such as a metal salt may be used. Examples thereof include: the above-mentioned water-soluble surfactant such as a cationic surfactant, an anionic surfactant and a nonionic surfactant; acids such as hydrochloric acid, sulfuric acid, nitric acid, acetic acid and oxalic acid; metal salts of inorganic acids such as magnesium chloride, calcium chloride, sodium chloride, aluminum chloride, aluminum sulfate, calcium sulfate, aluminum nitrate, silver nitrate, copper sulfate and sodium carbonate; metal salts of aliphatic acids and aromatic acids such as sodium acetate, potassium formate, sodium oxalate, sodium phthalate and potassium salicylate; metal salts of phenols such as sodium phenolate; metal salts of amino acids; salts of inorganic acids of aliphatic and aromatic amines such as triethanol amine hydrochloride and aniline hydrochloride; and inorganic polymers such as smectite, poly aluminum chloride and poly aluminum hydroxide. From the viewpoint of the stability of aggregated particles, stability of the flocculating agent with respect to heat and time-based endurance and removing property thereof at the time of washing, metal salts of inorganic acids are preferably used with high performances and applicability.

The amount of addition of the flocculating agent defers depending on the number of valence of charge. It is set to a small level in any of flocculating agents, and it is set to not more than 4% by weight in the case of monovalent charge, to not more than 2% by weight in the case of divalent charge, and to not more than 1% by weight in the case of trivalent charge. The smaller the amount of addition of the flocculating agent, the more preferable, and a compound having a higher number of valence is more preferably used since such a compound makes it possible to reduce the amount of addition.

The adhering process is normally completed by adding a stop agent so as to stop the aggregation (growth of particles). With respect to the stop agent, a nonionic surfactant, an anionic surfactant and, for example, a metal salt of an inorganic acid in which an antagonistic action is exerted between mutual metal ions, such as a sodium salt with a magnesium salt of an inorganic acid being used as a coagulating salt, are used. The amount of addition of the stop agent is set to a level greater than the amount of additives for stabilizing the aggregated particles. With respect to the entire dispersion system, it is set to 2 to 6% by weight in the case when the stop agent is a monovalent metal salt, and to 1 to 3% by weight in the case when it is a divalent metal salt.

The heating temperature in the "aggregation-adhering processes" is set to a temperature that allows the aggregating and adhering processes to take place simultaneously, and is normally set to a temperature of not less than the glass transition temperature of the resin fine particles, that is, for example, 60 to 85° C. In contrast, the heating temperature in the aggregating process in the latter method is set to a temperature that allows only the aggregating process to be achieved, and is normally set to a temperature less than the glass transition temperature of the resin fine particles, that is, for example, 25 to 55° C.

In the "fusing process", the dispersion system needs to be heated to a temperature that is not less than the adhering process, and is set to a temperature that is not less than the glass transition temperature, and not more than the melting point of the resin fine particles, that is, for example, to 70 to 110° C., and maintained at this temperature, if necessary.

By adjusting the various conditions in the "aggregation-adhering processes" and "fusing process", it is possible to control the particle-size distribution of the toner particles. For example, when the period of time in the aggregation-adhering processes is prolonged, the volume-average particle size becomes greater, making the rate of content of particles (small particles) having a particle size of not more than 1 $\mu$m, with an increased rate of content of particles (large particles) having a particle size of not less than 9 $\mu$m.

For example, as the number of stirring revolutions in the aggregation-adhering processes becomes slower, the aggregation takes place more easily. An abrupt aggregating process makes the particle-size distribution boarder.

For example, when the flocculating agent is loaded at once with an increased amount of addition, the aggregation takes place abruptly, making the particle-size distribution boarder.

When the temperature at the time of aggregation is low, the aggregation takes place slowly, making the particle size distribution broader.

When the pH at the time of aggregation is low, the aggregation takes place slowly, making the particle size distribution broader.

In this manner, the number of revolutions (stirring state), pH, temperature, amount of addition of flocculating agent, speed of addition and the like are adjusted so that the particle size distribution can be controlled.

Thereafter, the stirring state, temperature and time are controlled in the fusing process so that a final average particle size and surface shape of the toner are controlled.

For example, the slower the number of revolutions, the greater the particle size, making the particle size distribution broader. When the fusing process is carried out at a higher temperature, the shape becomes rounder with a smaller particle size.

With respect to the coloring agents, the following various kinds and various colors of organic and inorganic pigments may be used.

Examples of black pigments include carbon black, copper oxide, manganese dioxide, aniline black, activated carbon, non-magnetic ferrite, magnetic ferrite and magnetite.

Examples of yellow pigments include chrome yellow, zinc yellow, iron oxide yellow, Mineral Fast Yellow, nickel titanium yellow, Navel Yellow, Naphthol Yellow S, Hansa Yellow G, Hansa Yellow 10G, Benzidine Yellow G, Benzidine Yellow GR, Quinoline Yellow Lake, Permanent Yellow NCG and Tartradine Lake.

Examples of orange pigments include chrome red, molybdenum orange, Permanent Orange GTR, Pyrazolon Orange, Balkan Orange, Indanthrene Brilliant Orange RK, Benzidine Orange G and Indanthrene Brilliant Orange GK.

Examples of red pigments include colcothar, red lead, Permanent Red 4R, Lithol Red, Pyrazolon Red, Watching Red, calcium salt, Lake Red C, Lake Red D, Brilliant Carmine 6B, Eosin Lake, Rhodamine Lake B, Alizarine Lake and Brilliant Carmine 3B.

Examples of violet pigments include Manganese Violet, Fast Violet B and Methyl Violet Lake.

Examples of blue pigments include Ultramarine Blue, cobalt blue, Alkali Blue Lake, Victoria Blue Lake, Phthalocyanine Blue, non-metal Phthalocyanine Blue, phthalocyanine blue derivative, Fast Sky Blue and Indanthrene Blue BC.

Examples of green pigments include Chrome Green, chromium oxide, Pigment Green B, Marakite Green-Lake, Final Yellow Green G and Phthalocyanine Green.

Examples of white pigments include zinc oxide, titanium oxide, zirconium oxide, aluminum oxide, calcium oxide, calcium carbonate and tin oxide.

Examples of extender pigments include pearlite particles, barium carbonate, clay, silica, while carbon, talc, alumina white and kaolin.

These coloring agents may be used alone, or a plurality of these may be used in combination. With respect to the amount of use of the coloring agents, the content of the coloring agents is normally set to 1 to 20 parts by weight, more preferably 2 to 15 parts by weight with respect to 100 parts by weight of the polymer in the toner. When the amount of the coloring agents is too great, the toner fixing property might deteriorate, and when the amount thereof is too small, it becomes difficult to obtain desired image density.

The following description will explain other toner components that may be added to the polymer composition, or may be aggregated with the resin fine particles together with the coloring agents.

With respect to the release agent, a desired one of known waxes may be used. Examples thereof include: olefin-based waxes such as low-molecular-weight polyethylene, low-molecular-weight polypropylene and copolymer polyethylene, and paraffin wax; ester-based waxes having a long-chain aliphatic group, such as behenic acid ester, montan acid ester and stearic acid ester; plant-based waxes such as hydrogenated castor oil and carnauba wax; ketone having a long-chain alkyl group such as distearyl ketone;

silicone having an alkyl group; higher fatty acid such as stearic acid; (partial) ester between a polyhydric alcohol and a long-chain fatty acid, such as long-chain aliphatic alcohol, pentaerythritol and trimethylol propane; and higher fatty acid amide, such as oleic acid amide, stearic acid amide and palmitic acid amid.

With respect to the amount of use of these release agents, the content thereof is normally set to 1 to 25 parts by weight, preferably 3 to 20 parts by weight, more preferably 5 to 15 parts by weight, with respect to 100 parts by weight of the polymer in the toner.

With respect to the charge-controlling agent, various substances that apply a positive or negative charge through frictional charging may be used.

With respect to the positive charge-controlling agent, examples thereof include Nigrosine dyes such as Nigrosine base ES (made by Orient Chemical Industries, Ltd.); quaternary ammonium salts such as P-51 (made by Orient Chemical Industries, Ltd.) and Copy Charge PX VP435 (made by Clariant Corp.); alkoxylated amine; alkyl amide; chelate molybdate pigment; and imidazole compounds such as PLZ1001 (Shikoku Corp.).

With respect to the negative charge-controlling agent, examples thereof include metal complexes such as Bontron S-22 (made by Orient Chemical Industries, Ltd.), Bontron S-34 (made by Orient Chemical Industries, Ltd.), Bontron E-81 (made by Orient Chemical Industries, Ltd.), Bontron E-84 (made by Orient Chemical Industries, Ltd.) and Spilon Black TRH (made by Hodogaya Chemical Co., Ltd.); thioindigo pigments; calix arene compounds such as Bontron E-89 (made by Orient Chemical Industries, Ltd.); quaternary ammonium salts such as Copy Charge NX VP434 (made by Clariant Corp.); and fluorine compounds such as magnesium fluoride and carbon fluoride. Here, with respect to metal complexes that form a negative charge-controlling agent, in addition to those described above, compounds having various structures, such as metal complexes of oxycarboxylic acid, metal complexes of dicarboxylic acid, metal complexes of amino acid, metal complexes of diketone acid, metal complexes of diamine, metal complexes having an azo-group-containing benzene-benzene derivative skeleton and metal complexes having an azo-group-containing benzene-naphthalene skeleton, may be used.

The charge-controlling agent is preferably designed to have a particle size of approximately 10 to 100 nm, from the viewpoint of uniform dispersion. In the case when the agent that is commercially available has a particle size exceeding the upper limit of the above-mentioned range, the particle size thereof is preferably adjusted by using a known method such as a pulverizing process by the use of a jet mill or the like.

With respect to the magnetic particles, for example, magnetite, γ-hematite or various ferrites may be used.

In particular, at the preceding stage of "the fusing process", an adhesion process is placed, in which a fine particle dispersion solution is added to and mixed in the adhered particle dispersion solution to allow the fine particles to uniformly adhere to the surface of the adhered particles so that adhesion particles are formed. These adhesion particles are formed through a hetero-aggregation process or the like. Thereafter, a dispersion solution of these adhesion particles is supplied to "the above-mentioned fusing process".

The preparation of the adhesion process makes it possible to effectively suppress an integrally adhering process between adhesion particles in the fusing process thereafter so that, as a result, it becomes possible to easily achieve the above-mentioned particle-size distribution of the toner particles of the present invention.

With respect to the fine particles to be used in the adhesion process, organic fine particles may be used. Examples of the organic fine particles include styrene resin, acrylic resin and polyester resin. The volume-average particle size of the organic fine particles is preferably set to not more than 1 μm, preferably 0.01 to 1 μm.

After the formation of the toner particles (fused particles), toner particles are taken out of the toner particle dispersion solution, and impurities, mingled therein during the manufacturing processes, are removed in a washing process, and the resulting particles are dried.

In the washing process, acidic water, or basic water depending on cases, having an amount several times greater than that of the toner particles, is added to the toner particles, and this is then stirred and filtered to obtain a solid matter. Pure water having an amount several times greater than that of the solid matter is added to the solid matter, and this is then stirred and filtered. These processes are repeated several times, and stopped at the time when the pH of the filtrate after the filtering process has reached about 7, thereby obtaining toner particles.

In the drying process, the toner particles, obtained from the washing process, are dried at a temperature that is not more than the glass transition temperature. In this case, dried air may be circulated depending on required temperatures, or the heating process may be carried out under a vacuum state. In the drying process, any desired method, such as a normal vibration-type fluidized drying method, a spray drying method, a freeze-drying method and a flash jet method, may be used.

In the present invention, the toner may have a treatment agent that is applied to the surface or inside of the toner particles, in particular, to the surface thereof.

With respect to the above-mentioned treatment agent, a fluidity-improving agent such as fine particles of silica, alumina and titania, inorganic fine particles such as magnetite, ferrite and conductive titania, a resistance-adjusting agent such as styrene resin and acrylic resin, and a lubricant such as strontium titanate, cerium oxide, silicon carbide, and metal soap like zinc stearate, calcium stearate, manganese stearate and the same fluorine-containing resin fine particles as contained in the charge transporting layer.

In the case when a blade cleaning process is carried out in the image-forming method and the image-forming apparatus of the present invention, from the viewpoint of further improvements in the cleaning function, it is preferable to apply a fluidity-improving agent and a lubricant, in particular, a lubricant, to the surface of the toner particles. In this case, with respect to the lubricant, a combination of strontium titanate and metal soap is preferably used.

The amount of use of these additives is appropriately set depending on desired performances, and it is normally set to 0.05 to 10 parts by weight, with respect to 100 parts by weight of the toner particles (binder resin).

In the present invention, the mode of application of the toner is not particularly limited. Preferably the toner is used as a toner for a two-component developer. In the image-forming process using the two-component developer, not only the toner, but also the photosensitive member is subjected to influences of the carrier, with the result that the environment becomes severer in an attempt to obtain images having superior resolution and gradation for a long time. Even in such a severe environment, the present invention efficiently exerts its effects, and makes it possible to effectively provide images having superior resolution and gradation for a long time.

The following description will discuss the photosensitive member to be used in the present invention. The photosensitive member to be used in the present invention is a function-separate-type photosensitive member in which a charge-generating layer and a charge-transporting layer are successively laminated on a conductive supporting member, and fluorine-containing resin fine particles are contained in the charge-transporting layer on the outermost surface. When the fluorine-containing fine particles are not contained in the charge-transporting layer on the outermost surface, a problem is raised in which the resolution and gradation deteriorate during continuous printing processes, although high resolution and high gradation are achieved in the initial images. Another problem is that irregularities occur on the image from the initial stage of the printing processes. Still another problem is that filming and image losses occur during continuous printing processes. In addition to these layers, an intermediate layer such as a bonding layer and a blocking layer may be formed.

With respect to the conductive supporting member, any known members that have been adopted in the electrophotographic photosensitive member may be used. Examples of the conductive supporting member include: a metal drum and a sheet made of a material such as aluminum, stainless steel and cupper, or laminated member of metal foil of these, and a vapor deposition member of these. Examples thereof also include: materials, such as a plastic film, a plastic drum, paper and a paper pipe, to which a conductive substance such as metal particles, carbon black, cupper iodide and polymer electrolyte is applied together with an appropriate binder and conductive-treated thereon. A plastic sheet or belt, which is allowed to contain a conductive substance such as metal particles, carbon black and carbon fiber to be formed into a conductive material, may be used. Furthermore, a plastic film, a plastic drum and belt that have been conductive-treated by using a conductive metal oxide such as tin oxide and indium oxide may be used.

A blocking layer is placed between the conductive supporting member and the charge-generating layer, if necessary. With respect to the blocking layer, an alumite layer or an under coating layer using resin, or a layer using these in combination may be used.

When the alumite layer is formed, an aluminum base member is used as a conductive supporting member, and preferably, this is first subjected to a degreasing treatment by using various degrease-washing methods using acid, alkali, an organic solvent, a surfactant, emulsion and electrolysis. Next, this is then subjected to an anodic oxidizing treatment in an acidic bath such as chromic acid, sulfuric acid, oxalic acid, boric acid and sulfamic acid, preferably, in a sulfuric acid bath, so that an anodic oxide coat layer (alumite layer) is formed. The average layer thickness of the anodic oxide coat layer is normally set to 1 to 20 $\mu$m, preferably 1 to 7 $\mu$m.

The alumite layer, formed as described above, is subjected to a washing process such as immersion into water, water flow and water discharging, and a physical contact by a sliding member having a brush shape, a foam shape or a cloth shape, and then subjected to a drying process such as an air drying process and a heat-drying process.

In the case when the under coating layer is formed, for example, an aluminum base member, which has been subjected to a degreasing treatment in the same manner as the alumite layer, is coated with a solution obtained by dissolving polyamide such as N-methoxymethylated 6-nylon in an appropriate organic solvent, and dried. Inorganic fine particles such as titanium oxide, tin oxide and zirconium oxide are preferably contained in the under coat layer, from the viewpoint of proper surface roughness and resistance value.

The charge-generating layer contains at least a charge-generating material. Examples of the charge-generating material to be used in the present invention include: a cis-azo pigment, a tris-azo pigment, a triaryl methane dye, a thiazine dye, a cyanine dye, a styryl dye, a phthalocyanine pigment, a perylene pigment, a polycyclic quinone pigment, a benzimidazole pigment, an indanthrone pigment and a squalium dye. Among these, in particular, a phthalocyanine pigment is preferably used. With respect to the phthalocyanine pigment, titanyl phthalocyanine is preferably used from the viewpoint of sensitivity. To this are added an organic photoconductive compound, a pigment, an electron-attracting compound and the like, if necessary.

In the case when the charge-generating layer is formed by dispersing a charge-generating material in a binder resin, the content of the charge-generating material in the layer is set to 10 to 400 parts by weight, preferably 50 to 250 parts by weight, with respect to 100 parts by weight of the binder resin. In this case, with respect to the binder resin to be used in the charge-generating layer, examples thereof include: a polymer and a copolymer of vinyl compounds such as styrene, butyl acetate, vinyl chloride, acrylic acid ester, methacrylic acid ester, vinyl alcohol and ethylvinyl ether, polyvinyl acetal, polycarbonate, polyester, polyamide, polyurethane, cellulose ester, cellulose ether, phenoxy resin, silicon resin and epoxy resin.

The layer thickness of the charge-generating layer is set to 0.05 to 5 $\mu$m, preferably 0.1 to 2 $\mu$m. A charge-transporting layer to which a carrier is injected from the charge-generating layer is allowed to contain a charge-transfer material having high carrier injection efficiency and transfer efficiency.

Various additives, such as an antioxidant, a sensitizer, a plasticizer, a fluidity-applying agent and a cross-linking agent, may be contained in the charge-generating layer, if necessary.

When preparing a coating solution for forming the charge-generating layer, any known mixing dispersion machine, such as a sand mill, a ball mill, a homogenizer, a paint shaker and a nanomizer, may be used. With respect to the coating process of the coating solution, any known coating method may be used; examples thereof include: a roll coating method, an immersion coating method, an atomizing coating method and a ring coating method.

The charge-transporting layer is formed on the charge-generating layer. The following description will discuss, for example, a case in which a first charge-transporting layer and a second charge-transporting layer are formed in succession. In this case, fluorine-containing resin fine particles are contained in the second charge-transporting layer on the outermost surface.

The first charge-transporting layer is formed on the charge-generating layer formed as described above. The first charge-transporting layer is formed by applying a coating solution containing, at least, a charge-transporting material, a binder resin, if necessary, and an organic solvent onto the above-mentioned charge-generating layer and drying these thereon. The layer thickness of the first charge-transporting layer is set to 4 to 50 $\mu$m, preferably 5 to 25 $\mu$m.

With respect to the charge-transporting material to be used for forming the first charge-transporting layer, examples thereof include: hydrazine compound, styryl compound, benzyldiphenyl compound, triphenyl methane compound, oxadiazole compound, carbazole compound, stilbene compound, enamine compound, oxazole compound, triphenyl amine compound, tetraphenyl benzidine compound, tetraphenyl butadiene compound and azine compound. Resins having a photoconductive property, such as polyvinyl carbazole, polyvinyl anthracene, polyvinyl pyrene and polyvinyl pyrrole, may also be used. These materials may be used alone, or two or more kinds of these may be used in combination. When a binder resin is added to the first transport layer, the content of the charge-transporting material in the first charge-transporting layer is set to 2 to 200 parts by weight, preferably 50 to 120 parts by weight, with respect to 100 parts by weight of the binder resin.

With respect to the binder resin to be used for forming the first charge-transporting layer, resins that are the same as those exemplified as the binder resin to be used for the charge-generating layer may be used.

From the viewpoint of prevention against deterioration in the durability, the first charge-transporting layer preferably contains an antioxidant of a hindered phenol type, a hindered amine type, an organic phosphate type or an organic sulfur type and an ultraviolet-ray absorbing agent of a benzophenone type, a benzotriazole type or a benzoate type.

In the same manner as the charge-generating layer, the first charge-transporting layer may contain various additives such as a sensitizer, a plasticizer, a fluidity-applying agent and a cross-linking agent.

With respect to the organic solvent, not particularly limited, any solvent may be used as long as it can dissolve the binder resin to be used, and examples thereof include: tetrahydrofran, toluene, dioxane, dioxolane, monochlorobenzene, dichloroethane, methylene chloride and cyclohexane.

With respect to the preparation of a coating solution used for forming the first charge-transporting layer, known mixing dispersion machines that are the same as those used for preparing the coating solution for forming the charge-generating layer may be used. In the coating process of the coating solution also, known coating methods that are the same as those used for applying the coating solution for the charge-generating layer may be used.

Next, the second charge-transporting layer is formed. The second charge-transporting layer is formed by applying a coating solution containing fluorine-containing resin fine particles, a charge-transporting material, a binder resin and an organic solvent onto the above-mentioned first charge-transporting layer and drying it thereon. The thickness of the second charge-transporting layer is set to 0.1 to 15 $\mu$m, preferably 0.5 to 8 $\mu$m.

With respect to a charge-transporting material to be used for the formation of the second charge-transporting layer, the same materials as those used for forming the first charge-transporting layer may be used. The content of the charge-transporting material in the second charge-transporting layer is set to 2 to 200 parts by weight, preferably 50 to 120 parts by weight, with respect to 100 parts by weight of the binder resin.

With respect to the binder resin to be used for forming the second charge-transporting layer, applicable examples thereof include: thermoplastic resins such as polyester resin, polyamide resin, ethylene-vinyl acetate resin, polycarbonate resin, polyimide resin and cellulose-ester resin, thermosetting resins such as epoxy resin, urethane resin, alkyd resin and acryl-melamine resin, photo-curing resin, and photoconductive resins such as polyvinyl carbazole, polyvinyl anthracene, polyvinylene and polyvinyl pyrrole, and these materials may be used alone, or two or more kinds of these may be used in combination.

The fluorine-containing resin fine particles of the present invention are prepared as fine particles made from a single polymer or a copolymer formed by polymerizing an ethylene monomer that is substituted by a fluorine atom or a fluoroalkyl group. The polymer forming the fine particles may contain chlorine atoms.

Examples of the polymer forming such fluorine-containing resin fine particles include a single polymer or a copolymer or the like that is formed by polymerizing one or more monomers selected from the group consisting of tetrafluoroethylene, vinylidene fluoride, hexafluoropropylene, trifluorochloroethylene, vinyl fluoride, 3-fluoropropylene and 1-chloro-2-fluoroethylene.

Examples of the polymer forming preferable fluorine-containing resin fine particles include a single polymer or a copolymer or the like that is formed by polymerizing one or more monomers selected from the group consisting of tetrafluoroethylene, vinylidene fluoride, hexafluoropropylene and trifluorochloroethylene. In an attempt to further improve the resolution and gradation in an image as well as to improve the abrasion resistance and releasing property (cleaning property) of the photosensitive member, the fluorine-containing resin fine particles are preferably made from polytetrafluoroethylene, polyvinylidene fluoride or polyhexafluoropropylene.

The number-average molecular weight of the constituent polymer of the fluorine-containing resin fine particles is set to a high molecular weight of 100,000 to 1,000,000, in particular, 200,000 to 800,000, in an attempt to further improve the resolution, gradation and image quality (relating to irregularities) of an image, to improve the anti-abrasion property and releasing property, and also to provide proper dispersing property of the fine particles and desired preserving property of the coating solution.

The particle size of the above-mentioned fluorine-containing resin fine particles is preferably set to 0.01 to 2 $\mu$m, preferably 0.05 to 1 $\mu$m, more preferably, 0.05 to 0.5 $\mu$m, from the viewpoint of prevention of image noise and deterioration in the sensitivity of the photosensitive member. In the present specification, the particle size refers to the average primary particle size, and uses a value measured by a particle-size distribution measuring device LA920 (made by Horiba, Ltd.).

The content of the fluorine-containing resin fine particles is set to 1 to 40% by weight, preferably 5 to 35% by weight, with respect to the entire amount of the layer (in this case, the second charge-transporting layer) on the uppermost surface to which the fine particles are dispersed. Two or more kinds of the fluorine-containing resin fine particles may be used in combination, and in this case, the total amount of these may be set in the above-mentioned range. The content of less than 1% by weight fails to uniformly disperse the fine particles in the resulting layer, resulting in a difficulty in maintaining a desired releasing property for a long time. Therefore, it is not possible to provide an image having superior resolution and gradation for a long time. In contrast, the content exceeding 40% by weight makes the sensitivity of the photosensitive member deteriorate.

From the viewpoint of further improvements in the resolution, gradation and image-quality (relating to irregularities) in the resulting image as well as improvements in the anti-abrasion property and releasing property of the photosensitive member, it is more effective for the photosensitive member of the present invention to contain fine particles made from a resin having a frictional coefficient greater than the binder resin in addition to the fluorine-containing resin fine particles.

In the present invention, such fine particles made from a resin having a frictional coefficient greater than the binder resin are used, and by dispersing these fine particles in the second charge-transporting layer, it becomes possible to increase the frictional coefficient of the surface of the second charge-transporting layer. The frictional coefficient of the resin, which is greater than that of the binder resin, is normally set to 0.25 to 0.85, more preferably 0.4 to 0.7.

The particle size of the fine particles made from the resin having a frictional coefficient greater than that of the binder resin is preferably made greater than the particle size of the above-mentioned fluorine-containing resin fine particles, and is preferably set to a size not less than twice greater than the particle size of the fluorine-containing resin fine particles. Preferably, this is set to 2 to 20 times greater than the particle size thereof. When the particle size of the frictional-coefficient-improving resin fine particles is not more than the particle size of the fluorine-containing resin fine particles, it is not possible to provide a desired cleaning property. The particle size of the frictional-coefficient-improving resin fine particles is preferably set to, at most, not more than the toner particle size, and normally set to 0.03 to 5 $\mu$m, preferably 0.2 to 3 $\mu$m. When the particle size of the frictional-coefficient-improving resin fine particles is greater than the toner particle size, toner escape from the cleaning process tends to occur. Moreover, the resulting toner might damage peripheral elements such as the cleaner and the transfer belt.

With respect to the fine particles made from the resin having a frictional coefficient greater than the binder resin, examples thereof include: styrene resin fine particles, melamine resin fine particles, acrylic resin fine particles, silicone resin fine particles or phenol resin fine particles. In addition to these, any fine particles are preferably used as long as they are not dissolved in the organic solvent to be used in the coating solution of the charge-transporting layer.

The content of the fine particles made from the resin having a great frictional coefficient is set to 3 to 40% by weight, preferably 5 to 30% by weight, with respect to the content of the fluorine-containing resin fine particles. When the content of the frictional-coefficient-improving fine particles is too small, it is not possible to provide sufficient effects for improving the frictional coefficient of the surface of the photosensitive layer, resulting in toner escape and filming due to repeated use. In contrast, when the content thereof is too great, the frictional-coefficient-improving resin fine particles come to serve as a reinforcing material for the photosensitive member, and tend to cause filming on the surface of the photosensitive layer.

In the same manner as the first charge-transporting layer, in an attempt to suppress deterioration in the durability, additives, such as an antioxidant of a hindered phenol type, a hindered amine type, an organic phosphate type or an organic sulfur type and an ultraviolet-ray absorbing agent of a benzophenone type, a benzotriazole type or a benzoate type, are preferably added to the second charge-transporting layer.

In the same manner as the charge-generating layer, a plasticizer, an electron-attracting compound, a sensitizer and the like may be added to the second charge-transporting layer.

With respect to the organic solvent for forming the second charge-transporting layer, not particularly limited, any organic solvent may be used, as long as it is an organic solvent that dissolves the binder resin to be used, and does not dissolve the fluorine-containing resin fine particles and the frictional-coefficient-improving resin fine particles. Examples thereof include: tetrahydrofran, toluene, dioxane, dioxolane, monochlorobenzene, dichloroethane, methylene chloride and cyclohexane. More specifically, the solvent is appropriately selected from the above-mentioned organic solvents depending on the kinds of the binder resin, the fluorine-containing resin fine particles and the frictional-coefficient-improving resin fine particles. For example, in the case when polycarbonate resin is used as the binder resin, polytetrafluoroethylene fine particles are used as the fluorine-containing resin fine particles and silicone resin fine particles are used as the frictional-coefficient-improving resin fine particles, materials such as tetrahydrofran, toluene, dioxane, dioxolane, dichloroethane and methylene chloride, may be used.

When preparing the coating solution for forming the second charge-transporting layer, the afore-mentioned known mixing dispersion machines may be used. In the coating process of the coating solution, various known coating methods may be adopted in the same manner as the first charge-transporting layer.

The above-mentioned image-forming method and image-forming apparatus of the present invention have superior transferring property and cleaning property, and cause no filming, and the resulting image is free from noise such as an image loss for a long time. Further, the image-forming method and image-forming device of the present invention make it possible to effectively provide a small-size, high-speed apparatus.

EXAMPLES

The following description will discuss the present invention in more detail by means of examples; however, these examples are intended to be illustrative only and are not intended to limit the scope of the present invention. Also, parts are by weight unless otherwise indicated.

Manufacturing Example 1 of Photosensitive Member

The surface of a cylinder-shaped aluminum alloy of JIS5657 was subjected to a cutting process by using a cutting tool of natural diamond. This was subjected to a degreasing process, and washed with flowing water, and then subjected to an etching process in a diluted nitric acid bath. This was then subjected to an anodic oxidizing process, and a sealing process was carried out thereon by using nickel acetate to obtain an aluminum base member having an alumite layer having a thickness of 6 $\mu$m.

To 100 parts of tetrahydrofran were added 1 part of butyral resin (S-lec BX-1: made by Sekisui Chemical Co., Ltd.) and 1 part of m-type titanyl phthalocyanine, and this was dispersed by a sand mill for 5 hours to prepare a coating solution for a charge-generating layer. This charge-generating-layer coating solution was immersion-applied to the above-mentioned alumite layer, and dried to form a charge-generating layer having a layer thickness of 0.2 $\mu$m.

To 100 parts of tetrahydrofran were dissolved 10 parts of polycarbonate resin (Panlite TS-2020: made by TEIJIN CHEMICALS LTD.), 7 parts of styryl compound, represented by the following formula (I) and 0.8 parts of t-butylhydroxy toluene to prepare a first charge-transporting layer coating solution. This first charge-transporting layer coating solution was immersion-applied to the above-mentioned charge-generating layer, and this was dried through air flow to form a first charge-transporting layer having a layer thickness of 20 μm.

[Formula 1]

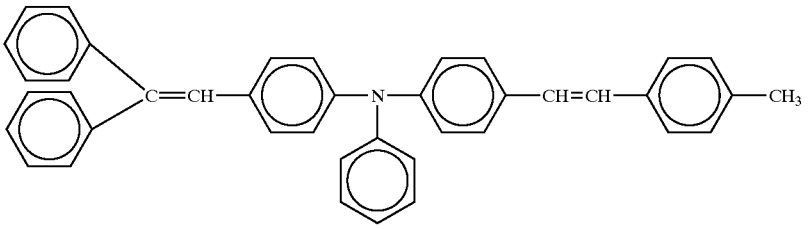

(I)

Then, 9 parts of polytetrafluoroethylene (particle size 0.2 μm, number-average molecular weight 300,000) serving as fluorine-containing resin fine particles was dispersed in 100 parts of tetrahydrofran so that a dispersion solution of fluororesin fine particles was prepared. Then, to 300 parts of tetrahydrofran were dispersed 10 parts of polycarbonate resin (Panlite TS-2020: made by TEIJIN CHEMICALS LTD., friction coefficient 0.61), 10 parts of styryl compound indicated by the above-mentioned formula (I), 0.8 parts of t-butylhydroxytoluene and 2 parts of silicone resin (particle size 0.5 μm), and to this was added the above-mentioned dispersion solution of the fluorine-containing resin fine particles. The resulting solution was dispersed for 30 minutes by ultrasonic waves to prepare the second charge-transporting layer coating solution. The second charge-transporting layer coating solution was applied to the above-mentioned first charge-transporting layer by using a ring coating device, and dried to form a second charge-transporting layer having a layer thickness of 5 μm. Thus, a photosensitive member 1 was obtained. The resin constituting the above-mentioned silicone resin fine particles had a friction coefficient of 0.55. With respect to the friction coefficient of the resin, the dynamic friction coefficient against a felt member (JIS-R33W) having a flat surface (2 cm×1 cm) of a resin block (5 cm×5 cm×0.1 cm) was measured by using a scratch tester (STV-101: made by Kasai K.K.).

Manufacturing Example 2 of Photosensitive Member

The surface of a cylinder-shaped aluminum alloy of JIS5657 was subjected to a cutting process by using a cutting tool of natural diamond. This was subjected to a degreasing process, and washed with flowing water. Next, 8 parts of titanium oxide (TTO-55N made by ISHIHARA SANGYO KAISHA, LTD.) and 8 parts of N-methoxymethylated 6-nylon (weight-average molecular weight 120,000) were dispersed by a sand mill for 4 hours together with 84 parts of mixed alcohol (ethanol/n-propanol=1/1: weight ratio) to obtain an undercoat layer coating solution. This undercoat layer coating solution was immersion-applied onto the above-mentioned aluminum drum, and dried to form an undercoat layer having a layer thickness of 0.8 μm.

To 100 parts of tetrahydrofran were added 1 part of butyral resin (S-lec BX-1: made by Sekisui Chemical Co., Ltd.) and 1 part of Y-type titanyl phthalocyanine, and this was dispersed by a sand mill for 5 hours to prepare a charge-generating-layer coating solution. This charge-generating-layer coating solution was immersion-applied to the undercoat layer, and dried to form a charge-generating layer having a layer thickness of 0.2 μm.

To 100 parts of tetrahydrofran were dissolved 10 parts of polycarbonate resin (Panlite TS-2020: made by TEIJIN CHEMICALS LTD.), 7 parts of a benzyl diphenyl compound, represented by the following formula (II) and 0.8 parts of t-butylhydroxy toluene to prepare a first charge-transporting layer coating solution. This first charge-transporting layer coating solution was immersion-applied to the above-mentioned charge-generating layer, and this was dried through air flow to form a first charge-transporting layer having a layer thickness of 16 μm.

[Formula 2]

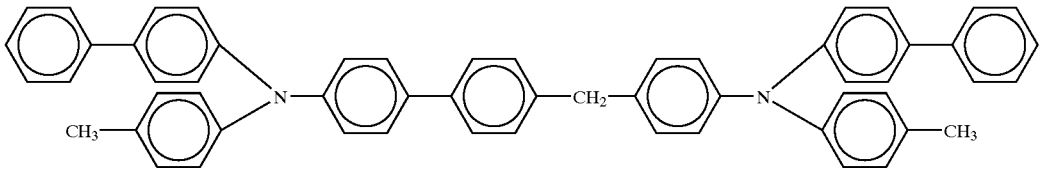

(II)

Next, 9 parts of polytetrafluoroethylene (particle size 0.1 μm, number-average molecular weight 500,000) serving as fluorine-containing resin fine particles was dispersed in 100 parts of tetrahydrofran so that a dispersion solution of fluororesin fine particles was prepared. Then, to 300 parts of tetrahydrofran were dispersed 10 parts of polycarbonate resin (Panlite TS-2020: made by TEIJIN CHEMICALS LTD., friction coefficient 0.61), 10 parts of benzyl diphenyl compound indicated by the above-mentioned formula (II), 0.8 parts of t-butylhydroxytoluene and 3 parts of phenol resin fine particles (particle size 1.2 μm), and to this was added the above-mentioned dispersion solution of the fluorine-containing resin fine particles. The resulting solution was dispersed for 30 minutes by ultrasonic waves to prepare the second charge-transporting layer coating solution. The second charge-transporting layer coating solution was applied to the above-mentioned first charge-transporting layer by using a ring coating device, and dried to form a second charge-transporting layer having a layer thickness of 7 μm. Thus, a photosensitive member 2 was obtained. The resin constituting the above-mentioned phenol resin fine particles had a friction coefficient of 0.53.

Manufacturing Example 3 of Photosensitive Member

The surface of a cylinder-shaped aluminum alloy of JIS5657 was subjected to a cutting process by using a cutting tool of natural diamond. This was subjected to a degreasing process, and washed with flowing water. Next, 10 parts of zirconium tetraacetyl acetonate (ZC-150: made by Matsumoto kosho K.K.), 0.5 parts of γ-(2-aminoethyl) aminopropyl trimethoxysilane (SH-6020: made by Toray Dow Corning Ltd.) were dissolved in 100 parts of a mixed alcohol (methanol/n-propanol=3/1: weight ratio) to obtain an undercoat layer coating solution. This undercoat layer coating solution was immersion-applied onto the above-mentioned aluminum drum, and baked. This process was repeated four times to prepare a layer thickness of 0.8 μm. Thus, an undercoat layer was formed.

Next, to 100 parts of tetrahydrofran were added 1 part of butyral resin (S-lec BX-1: made by Sekisui Chemical Co., Ltd.) and 1 part of 1-type titanyl phthalocyanine, and this was dispersed by a sand mill for 5 hours to prepare a coating solution for a charge-generating layer. This charge-generating-layer coating solution was immersion-applied to the above-mentioned undercoat layer, and dried to form a charge-generating layer having a layer thickness of 0.2 μm.

Then, to 100 parts of tetrahydrofran were dissolved 10 parts of polycarbonate resin (Panlite TS-2020: made by TEIJIN CHEMICALS LTD.), 7 parts of benzyl diphenyl compound, represented by the following formula (III) and 0.8 parts of t-butylhydroxy toluene to prepare a first charge-transporting layer coating solution. This first charge-transporting layer coating solution was immersion-applied to the above-mentioned charge-generating layer, and this was dried through air flow to form a first charge-transporting layer having a layer thickness of 20 μm.

the above-mentioned formula (III) and 0.8 parts of t-butylhydroxytoluene, and to this was added the above-mentioned dispersion solution of the fluorine-containing resin fine particles. The resulting solution was dispersed for 30 minutes by ultrasonic waves to prepare the second charge-transporting layer coating solution. The second charge-transporting layer coating solution was applied to the above-mentioned first charge-transporting layer by using a ring coating device, and dried to form a second charge-transporting layer having a layer thickness of 4 μm. Thus, a photosensitive member 3 was obtained.

Manufacturing Example 4 of Photosensitive Member

The surface of a cylinder-shaped aluminum alloy of JIS5657 was subjected to a cutting process by using a cutting tool of natural diamond. This was subjected to a degreasing process, and washed with flowing water. Next, 8 parts of titanium oxide (TTO-55N made by ISHIHARA SANGYO KAISHA, LTD.) and 8 parts of N-methoxymethylated 6-nylon (weight-average molecular weight 120,000) were dispersed by a sand mill for 4 hours together with 84 parts of mixed alcohol (ethanol/n-propanol=1/1: weight ratio) to obtain an undercoat layer coating solution. This undercoat layer coating solution was immersion-applied onto the above-mentioned aluminum drum, and dried to form an undercoat layer having a layer thickness of 0.8 μm.

To 100 parts of tetrahydrofran were added 1 part of butyral resin (S-lec BX-1: made by Sekisui Chemical Co., Ltd.) and 1 part of Y-type titanyl phthalocyanine, and this was dispersed by a sand mill for 5 hours to prepare a charge-generating-layer coating solution. This charge-generating-layer coating solution was immersion-applied to the undercoat layer, and dried to form a charge-generating layer having a layer thickness of 0.2 μm.

To 100 parts of tetrahydrofran were dissolved 10 parts of polycarbonate resin (Panlite TS-2020: made by TEIJIN CHEMICALS LTD.), 7 parts of a benzyl diphenyl compound represented by the above-mentioned (II) and 0.8 parts of t-butylhydroxy toluene to prepare a first charge-transport-layer coating solution. This first charge-transporting layer coating solution was immersion-applied to the above-mentioned charge-generating layer, and this was dried through air flow to form a first charge-transporting layer having a layer thickness of 16 μm.

[Formula 3]

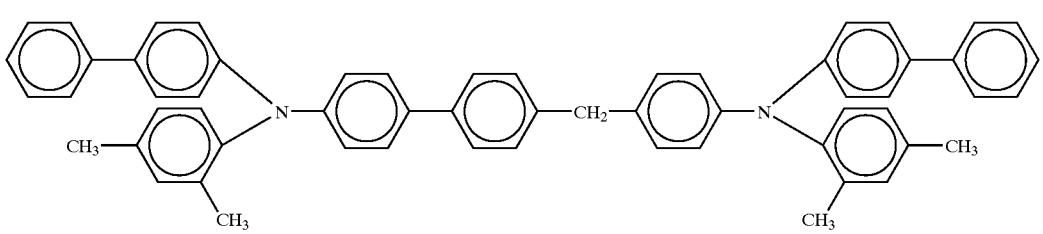

(III)

Next, 9 parts of polyhexafluoropropylene (particle size 0.2 μm, number-average molecular weight 700,000) serving as fluorine-containing resin fine particles was dispersed in 100 parts of tetrahydrofran so that a dispersion solution of fluororesin fine particles was prepared. To 300 parts of tetrahydrofran were dispersed 10 parts of polycarbonate resin (Panlite TS-2020: made by TEIJIN CHEMICALS LTD.), 10 parts of benzyl diphenyl compound indicated by Next, to 300 parts of tetrahydrofran were dispersed 10 parts of polycarbonate resin (Panlite TS-2020: made by TEIJIN CHEMICALS LTD.), 10 parts of benzyl diphenyl compound represented by the above-mentioned formula (II), 0.8 parts of t-butylhydroxytoluene and 10 parts of phenol resin fine particles (particle size 1.2 μm) to prepare the second charge-transporting layer coating solution. The second charge-transporting layer coating solution was applied to the above-mentioned first charge-transporting layer by using a ring coating device, and dried to form a second charge-transporting layer having a layer thickness of 7 μm. Thus, a photosensitive member 4 was obtained. The resin constituting the above-mentioned phenol resin fine particles had a friction coefficient of 0.53.

Manufacturing Example 1 of Toner

To a reaction flask provided with a stirring device, a heating-cooling device, a condenser and a material-assistant loading device was loaded a solution prepared by dissolving 1.4 parts of dodecyl sulfonic acid soda in 600 parts of ion exchange water, and the inner temperature was raised to 80° C. while being stirred at a stirring rate of 200 rpm under a nitrogen gas flow. To this solution was added a solution prepared by dissolving 1.8 parts of potassium persulfate in 40 parts of ion exchange water. After this had been set to a temperature of 75° C., a monomer mixed solution composed of 14 parts of styrene, 4 parts of n-butylacrylate and 2 parts of methacrylic acid was dripped in 30 minutes so that a polymerization process was carried out at 75° C. in this system to prepare latex A1.

Next, to a reaction flask provided with a stirring device, a heating-cooling device, a condenser and a material-assistant loading device was loaded a monomer mixed solution composed of 21 parts of styrene, 6 parts of n-butyl acrylate, 1.3 parts of methacrylic acid and 1.1 parts of 2-mercapto ethyl octanoate, and to this was added 14 parts of paraffin wax (NHP0190: made by Nippon Seiro Co., Ltd.). The resulting mixture was heated to 85° C. and dissolved to prepare a monomer solution. A solution, prepared by dissolving 0.3 parts of dodecylsulfonic acid soda in 540 parts of ion exchange water, was heated to 80° C., and after 5.6 parts of the above-mentioned latex A1 on the basis of solid component basis had been added to this solution, the above-mentioned monomer solution was mixed and dispersed by a homogenizer TK homomixer (made by Tokushu Kika Kogyo Co,. Ltd.) so that an emulsion solution was prepared. To this emulsion solution were added a solution prepared by dissolving 1 part of potassium persulfate in 50 parts of ion exchange water, and 150 parts of ion exchange water. After having been set to 80° C., this was subjected to a polymerization process for 3 hours to obtain latex B1.

To latex B1 obtained as described above was added a solution prepared by dissolving 1.5 parts of potassium persulfate in 40 parts of ion exchange water. After the temperature thereof had been set to 80° C., to this was dripped a monomer mixed solution composed of 60 parts of styrene, 19 parts of n-butylacrylate, 3 parts of methacrylic acid and 2.1 parts of 2-mercapto ethyl octanoate in 30 minutes. After this system had been subjected to a polymerizing process for 2 hours at 80° C., this was cooled to 30° C. to obtain latex C1. The volume-average particle size of the resin fine particles in latex C1 was 150 nm.

To 300 parts of ion exchange water was dissolved 12 parts of n-dodecyl sodium sulfate while being stirred. While this solution was being stirred, 84 parts of carbon black (Regal 330: made by Cabot Co., Ltd.) was gradually added, and then dispersed by using a TK homomixer (made by Tokushu Kika Kogyo Co,. Ltd.) to obtain a dispersion solution of a coloring agent.

The above-mentioned latex C1 (84 parts)(as expressed in terms of solid component basis), 180 parts of ion exchange water and 33 parts of the above-mentioned coloring agent dispersion solution were put into a reaction flask provided with a stirring device, a heating-cooling device, a condenser and a material-assistant loading device, and stirred. After the inner temperature had been set to 30° C., a water solution of 5N sodium hydroxide was added to this so that the pH value was adjusted to 11.0. Next, a solution, prepared by dissolving 2.4 parts of magnesium chloride 6 hydrate in 200 parts of ion exchange water, was dripped therein at 30° C. in 10 minutes, and this system was then heated to 80° C. in 6 minutes (aggregation-adhering processes). Then, to this was added a solution prepared by dissolving 16 parts of sodium chloride in 200 parts of ion exchange water so that the growth of particles was stopped. This was maintained at a solution temperature of 85° C. for 2 hours as an aging process (fusing process). Thereafter, this solution was cooled to 30° C., and hydrochloric acid was added thereto to adjust the pH value to 2.0, and the stirring process was stopped. The fused particles thus obtained were filtered, and repeatedly washed with ion exchange water, and then dried by hot air of 40° C. so that toner particles having a volume-average particle size of 4.5 μm were obtained.

Hydrophobic silica (0.3 parts)(H-2000; made by Wacker Co., Ltd.), hydrophobic titanium oxide (0.5 parts)(T-805: made by Nippon Aerosil Co., Ltd.), strontium titanate (0.3 parts) and zinc stearate (0.1 parts) were added to 100 parts of the resulting toner particles, and the mixture was subjected to a post process by using a Henschel mixer (made by Mitui Miike Kakouki K.K.) at 1,000 rpm for 1 minute to obtain toner A.

In the aggregation-adhering process in toner manufacturing example 1, the number of revolutions in the stirring process, pH, temperature and its holding time at the time when the magnesium chloride solution was added, the temperature and time in the succeeding heating process and the period of time from the addition of the magnesium chloride solution to the addition of the sodium chloride solution were properly changed so that toner B, toner C, toner D and toner E having various particle-size distributions as shown in the following Table 1 were obtained.

Manufacturing Example 2 of Toner

To a reaction flask provided with a stirring device, a heating-cooling device, a condenser and a material-assistant loading device were loaded a solution prepared by 270 parts of styrene, 30 parts of n-butyl acrylate, 5 parts of acrylic acid and 20 parts of 2 -mercapto ethyl octanoate, and a solution prepared by dissolving 6 parts of a nonionic surfactant (Nonipole 400: made by SANYO KASEI Co., Ltd.) and 10 parts of an anionic surfactant (Neogen SC: made by DAIICHI KOGYO SEIYAKU Co., Ltd.) in 600 parts of ion exchange water, and these solutions were dispersed, and emulsified. While this was stirred and mixed slowly for 10 minutes, 50 parts of ion exchange water in which 4 parts of ammonium persulfate was added thereto. Then, after the inside of the flask had been sufficiently substituted by nitrogen, the system was heated to 80° C. inside thereof in an oil bath while being stirred. In this state, the emulsification polymerization was continued for 5 hours. Thereafter, the reaction solution was cooled to room temperature to obtain latex D1. The volume-average particle size of the resin fine particles in latex D1 was 120 nm.

To 120 parts of ion exchange water was dissolved 5 parts of n-dodecyl sodium sulfate while being stirred. While this solution was being stirred, 25 parts of yellow pigment (Pigment Yellow 180: made by Clariant Japan Corp.) was gradually added thereto, and then dispersed by using a TK homomixer (made by Tokushu Kika Kogyo Co,. Ltd.) to obtain a dispersion solution of a coloring agent.

To 150 parts of ion exchange water was dissolved 5 parts of n-dodecyl sodium sulfate while being stirred. While this solution was being stirred, 30 parts of paraffin wax (NHP0190: made by Nippon Seiro Co., Ltd.) was added thereto. This was heated and dissolved at 85° C., and then dispersed by using a TK homomixer (made by Tokushu Kika Kogyo Co,. Ltd.) to obtain a dispersion solution of a release agent.

The above-mentioned latex D1 (resin fine particles)(70 parts)(on the basis of solid component basis), 20 parts of the above-mentioned coloring-agent dispersion solution, 20 parts of the above-mentioned release agent dispersion solution and 0.8 parts of poly(aluminum hydroxide) (Asada Kagaku Kogyo K.K.) were dispersed by using a TK homomixer (made by Tokushu Kika Kogyo Co,. Ltd.). The resulting solution was put into a reaction flask provided with a stirring device, a heating-cooling device, a condenser and a material-assistant loading device, and stirred therein. The inner temperature thereof was set to 65° C. After having been maintained at 65° C. for 2 hours, to this dispersion solution was gradually added 30 parts of latex D1 (on the basic of solid component basis), and the temperature of the inside of the system was raised to 70° C., and maintained for 1 hour (aggregation-adhering process). Then, to the above-mentioned dispersion solution was added 2 parts of an anionic surfactant (Neogen SC: made by DAIICHI KOGYO SEIYAKU Co., Ltd.) so that the growth of particles was stopped, and this system was maintained at a solution temperature of 95° C. for 4 hours as a curing process (fusing process). Thereafter, this solution was cooled to 30° C., and the stirring process was stopped. The fused particles thus obtained were filtered with the pH value being adjusted to 11.5 by adding a water solution of sodium hydroxide, and then washed at 40° C. The resulting particles were washed with ion exchange water repeatedly, and then dried by hot air at 40° C. so that toner particles having a volume-average particle size of 5.5 μm were obtained.

Hydrophobic silica (0.3 parts)(H-2000; made by Wacker Co., Ltd.), hydrophobic titanium oxide (0.5 parts)(T-805: made by Nippon Aerosil Co., Ltd.), strontium titanate (0.3 parts) and calcium stearate (0.1 parts) were added to 100 parts of the resulting toner particles, and the mixture was subjected to a post process by using a Henschel mixer (made by Mitui Miike Kakouki K.K.) at 1000 rpm for 1 minute to obtain toner F.

In the aggregation-adhering process in toner manufacturing example 2, the pH, number of revolutions, temperature and its holding time at the time of stirring the dispersion solution are properly changed so that toner G and toner H having various particle-size distributions as shown in the following Table 1 were obtained.

Manufacturing Example 3 of Toner

In the aggregation-adhering process in toner manufacturing example 1, the pH, number of revolutions, temperature and its holding time at the time when the magnesium chloride solution is added, the temperature and time in the succeeding heating process and the period of time from the addition of the magnesium chloride solution to the addition of the sodium chloride solution were properly changed so that toner I, toner J, toner K and toner L having various particle-size distributions as shown in the following Table 1 were obtained.

(Preparation of Carrier)

To a flask of 500 ml provided with a stirring device, a condenser, a thermometer, a nitrogen introducing tube and a dripping device was loaded 100 parts of methylethylketone. In a separate manner from this, to 100 parts of methylethylketone were added and dissolved 36.7 parts of methylmethacrylate, 5.1 parts of 2-hydroxylethylmethacrylate, 58.2 parts of 3-methacryloxypropyltris(trimethylsiloxane)silane and 1 part of 1,1'-azobis (cyclohexane-1-carbonitrile) at 80° C. under a nitrogen atmosphere to prepare a solution. This solution was dripped into the above-mentioned flask for two hours and matured for five hours. To the resulting resin solution was added an isophoronediisocyanate/trimethylolpropane adduct (IPDI/TPM series: NCO%=6.1%) as a cross-linking agent, so as to adjust the OH/NCO mole ratio to 1/1, and this was diluted by methylethylketone so that a coat resin solution having a solid component ratio of 3% by weight was prepared.

By using calcined ferrite particles (average particle size: 30 μm) as a core material, the above-mentioned coat resin solution was applied thereto and dried by a Spira Cota (made by OKADA SEIKO Co,. Ltd.) so that the amount of coated resin to the core material was set at 1.5% by weight. The resultant carrier was left in a hot-air circulating oven for one hour at 160° C. so as to be baked. The carrier thus obtained had an average particle size of 31 μm and an electrical resistance of approximately $3\times10^{10}$ Ωcm.

Examples and Comparative Examples

In examples and comparative examples, toners and photosensitive members shown in Table 1 were used in combination so that the following evaluations were carried out. Here, the toner was mixed with the above-mentioned carrier at a weight ratio of 5:95 (toner:carrier) to prepare a developer, and this developer was used.

The volume-average particle size and particle-size distribution (a rate of particles having a particle size of not more than 1 μm (volume %) and a rate of particles having a particle size of not less than 9 μm (volume %)) were measured by using a Coulter Counter made by Coulter Co., Ltd. Furthermore, "volume-average particle size (nm) of emulsion polymerization particles in latex", described in the toner manufacturing example, was measured by using a particle size distribution meter, Microtrack UPA150, made by Nikkiso Co., Ltd.

TABLE 1

| | Toner | | | | |
|---|---|---|---|---|---|
| | Kinds | Average particle size (μm) | not more than 1 μm | not less than 9 μm | Photosensitive member |
| Example 1 | A | 4.5 | 0.3% | 0.3% | 1 |
| Example 2 | B | 3.0 | 0.8% | 0% | 1 |
| Example 3 | C | 3.6 | 0.5% | 0.1% | 1 |

TABLE 1-continued

| | Toner | | | | |
|---|---|---|---|---|---|
| | Kinds | Average particle size (μm) | not more than 1 μm | not less than 9 μm | Photosensitive member |
| Example 4 | D | 5.2 | 0.2% | 0.4% | 2 |
| Example 5 | E | 5.3 | 0.2% | 0.5% | 2 |
| Example 6 | F | 5.5 | 0% | 0.8% | 3 |
| Example 7 | G | 5.1 | 0.2% | 0.4% | 3 |
| Example 8 | H | 4.7 | 0.3% | 0.3% | 3 |
| Comparative Example 1 | I | 6.7 | 0% | 2.1% | 3 |
| Comparative Example 2 | J | 5.8 | 0.1% | 0.7% | 4 |
| Comparative Example 3 | K | 4.8 | 1.8% | 1.2% | 3 |
| Comparative Example 4 | A | 4.5 | 0.3% | 0.3% | 4 |
| Comparative Example 5 | L | 6.0 | 0.8% | 0.8% | 1 |

(Evaluations of Characteristics)

Quantity of Charge

The developer (30 g) was placed in a polyethylene bottle having a capacity of 50 ml. The bottle was rotated at 1,200 rpm for 90 minutes so that the developer was stirred. The developer was made in contact with a film that had been charged to have a predetermined quantity of charge. The quantity of charge of the toner (μC/g) was determined by measuring the weight of toner adhering to the film.

Contact Angle

The contact angle was measured in the following manner: contact angles with respect to water of arbitrary three points that were set on the surface of a layer that had the same composition as the second charge-transporting layer, and was formed into a flat face. The average value of these was found. A CA-II roll-type contact angle meter (made by Kyowa Interface Science Co., Ltd.) was used so as to measure a contact angle with respect to distilled water on the uppermost surface.

Friction Coefficient

With respect to the friction coefficient on the surface of the photosensitive layer, a dynamic friction coefficient of a layer having the same composition as the charge-transporting layer formed into a flat face against a felt member (JIS-R33W) was measured by a scratch tester STV101 (made by Kasai K.K.). Dynamic friction coefficients were measured at three arbitrary points, the friction coefficient was obtained by averaging these three values.

Evaluations on the following items were carried out by installing a predetermined photosensitive member and developer in a commercial color laser copying machine (Dialta Color CF3102: made by MINOLTA Co., Ltd.). The recording dot density of an exposing device in this copying machine was set to 600 dots/inch.

Gradation

An image, which allowed the image density to be identified as 10 degrees based upon area rates of mesh points, was printed out so that evaluations were made based upon degrees of the density that were identified. These evaluations were carried out at the initial stage and a stage after 10,000 copies had been outputted. The density of not less than "9-th degree" caused no problems in practical use. The density of not more than "8-th degree" was in a range that caused problems in practical use.

Resolution 1

Longitudinal lines the numbers of which were respectively set to 14, 17, 20 and 23 per 1 mm were formed with the same intervals, and evaluation was made as to how many lines were discriminated. The greatest number of longitudinal lines that were discriminated was shown. These evaluations were carried out at the initial stage and a stage after 10,000 copies.

With respect to the resolution, when the above-mentioned resolution 1 is evaluated as "not less than 17 lines" and the resolution 2, which will be described later, is also evaluated as not less than A, this state is considered to be within a range that causes no problems in practical use.

Resolution 2

When evaluating with respect to resolution 1, the image portion having the greatest number of longitudinal lines that were discriminated was further evaluated by using a magnifier (magnification×90) based upon the following criteria. These evaluations were carried out at the initial stage and a stage after 10,000 copies had been outputted.

○: Longitudinal lines are completely separated;

Δ: Separation of longitudinal lines is partially imperfect.

x: Separation of longitudinal lines is imperfect as a whole.

Amount of Abrasion (μm)

Images of A4 size were continuously printed, and after 10,000 copies had been outputted, amounts of abrasion were measured by a layer thickness meter (EC8e2Ty: made by Fisher Co., Ltd.) at three points on a photosensitive member, that is, the two ends and the center portion, and these values were averaged.

Image Loss

Images of A4 size were continuously printed, and after 10,000 copies had been outputted, the image loss rate (%) was calculated. The image loss rate was defined as follows: solid images of right triangles the length of one side of which was set to 1, 2, 3, 4 or 5 mm, with the number of the triangles of each type being set to 20 (total 100), were printed so that the rate of the number of right triangles that had defective portions was determined as the image loss rate. The rate of the number of such triangles was visually measured, and evaluation was made in the following manner:

◎: less than 15%

○: not less than 15% to less than 25%;

Δ: not less than 25% to less than 40%;

x: not less than 40% to less than 60% xx: not less than 60%

Cleaning Property

Images of A4 size were continuously printed, and after 10,000 copies had been outputted, evaluation was made on the surface state of a photosensitive member in the following manner.

○: No filming occurred, with superior surface state;

Δ: Filming partially occurred slightly; however, no problem was raised in practical use;

x: Filming occurred entirely

Image Quality

A chart image of A4 size having a black-white ratio of 5% was continuously printed, and evaluations were carried out on images at the initial stage and images at a stage after 10,000 copies had been outputted based upon states of image quality.

◎: No irregularities were observed with superior image quality;

○: Irregularities were slightly observed; however, image quality was good as a whole;

Δ: Irregularities were partially observed; however, image quality caused no problems in practical use;

x: Irregularities occurred entirely, causing problems in practical use;

xx: Character images were hardly read due to irregularities, and image quality was poor.

The following Table shows the results of evaluations:

TABLE 2

| | Quantity of charge (μC/g) | Gradation (Initial → After endurance printing) | Resolution 1 (Initial → After endurance printing) | Resolution 2 (Initial → After endurance printing) | Amount of abrasion (μm) |
|---|---|---|---|---|---|
| Example 1 | −40 | 10-th degree → 10-th degree | 23 lines → 20 lines | ○ → ○ | 0.5 |
| Example 2 | −45 | 10-th degree → 10-th degree | 23 lines → 20 lines | ○ → ○ | 0.4 |
| Example 3 | −42 | 10-th degree → 10-th degree | 23 lines → 20 lines | ○ → Δ | 0.5 |
| Example 4 | −38 | 10-th degree → 9-th degree | 20 lines → 17 lines | ○ → ○ | 0.5 |
| Example 5 | −37 | 10-th degree → 9-th degree | 20 lines → 17 lines | ○ → Δ | 0.6 |
| Example 6 | −36 | 10-th degree → 9-th degree | 20 lines → 17 lines | Δ → Δ | 0.3 |
| Example 7 | −38 | 10-th degree → 9-th degree | 20 lines → 17 lines | ○ → Δ | 0.3 |
| Example 8 | −39 | 10-th degree → 10-th degree | 23 lines → 20 lines | ○ → ○ | 0.2 |
| Comparative Example 1 | −33 | 9-th degree → 8-th degree | 17 lines → 14 lines | Δ → x | 0.7 |
| Comparative Example 2 | −36 | 10-th degree → 6-th degree | 20 lines → — | ○ → x | 3.2 |
| Comparative Example 3 | −38 | 10-th degree → 8-th degree | 20 lines → 14 lines | Δ → x | 1.0 |
| Comparative Example 4 | −40 | 10-th degree → 7-th degree | 20 lines → — | Δ → x | 2.8 |
| Comparative Example 5 | −36 | 10-th degree → 9-th degree | 17 lines → 14 lines | Δ → x | 0.7 |

"—" refers to a case in which it was not possible to discriminate even 14 longitudinal line images.

TABLE 3

| | Image loss | Cleaning property | Contact angle (°) | Image quality (Initial → After endurance printing) | Friction coefficient |
|---|---|---|---|---|---|
| Example 1 | ◎ | ○ | 96 | ◎ → ○ | 0.30 |
| Example 2 | ◎ | ○ | 96 | ◎ → ○ | 0.30 |
| Example 3 | ◎ | ○ | 96 | ◎ → ○ | 0.30 |
| Example 4 | ◎ | ○ | 99 | ◎ → ○ | 0.28 |
| Example 5 | ◎ | ○ | 99 | ◎ → ○ | 0.28 |
| Example 6 | ◎ | ○ | 103 | ◎ → ○ | 0.18 |
| Example 7 | ◎ | ○ | 103 | ◎ → ○ | 0.18 |
| Example 8 | ◎ | ○ | 103 | ◎ → ○ | 0.18 |
| Comparative Example 1 | ○ | ○ | 103 | ◎ → x | 0.18 |
| Comparative Example 2 | x | x | 85 | ○ → xx | 0.36 |
| Comparative Example 3 | ○ | x | 103 | ◎ → x | 0.18 |
| Comparative Example 4 | ○ | x | 85 | ○ → x | 0.36 |
| Comparative Example 5 | ○ | ○ | 96 | ○ → Δ | 0.30 |

EFFECTS OF THE INVENTION

In accordance with the image-forming method and the image-forming apparatus of the present invention, it is possible to easily provide an image that has superior resolution and gradation and is free from irregularities and image-loss portions, stably for a long time.

What is claimed is:

1. A photosensitive member comprising a charge transporting layer on a charge generating layer, the charge transporting layer comprising plural layers having an uppermost-surface layer containing fluorine-containing resin fine particles, a binder resin and fine particles made from a resin having a frictional coefficient greater than the binder resin.

2. The photosensitive member of claim 1, wherein an average primary particle size of the fine particles made from the resin having a frictional coefficient greater than that of the binder resin is greater than an average primary particle size of the fluorine-containing resin fine particles.

3. An image-forming apparatus, comprising:

a function divided photosensitive member with a charge transporting layer laminated on a charge generating layer, the charge transporting layer comprising plural layers and having an uppermost-surface layer containing fluorine-containing resin fine particles, a binder resin and fine particles made from a resin having a frictional coefficient greater than the binder resin;

a charging device to uniformly charge the surface of the photosensitive member, an exposing device to expose the charged photosensitive member according to image-information to form electrostatic latent images, the exposing device being a digital image exposing device having a recording dot density of not less than 400 dots/inch;

a developing device to develop the electrostatic latent images; and a toner contained in the developing device having a volume-average particle size of 2 to 5.5 $\mu$m, with a ratio of content of particles having a particle size of not more than 1 $\mu$m being set to not more than 1.0 volume %.

4. An image-forming apparatus of claim 3, wherein the charge generating layer contains a phthalocyanine pigment.

5. An image-forming apparatus of claim 3, wherein the fluorine-containing resin fine particles are resin fine particles obtained by polymerizing one or more monomers selected from the group consisting of tetrafluoroethylene, vinylidene fluoride, hexafluoropropylene and trifluorochloroethylene.

6. An image-forming apparatus of claim 3, wherein the uppermost surface layer contains the fluorine-containing resin fine particles at a content of 1 to 40% by weight.

7. An image-forming apparatus of claim 3, wherein the frictional coefficient of the resin having a frictional coefficient greater than the binder resin is 0.25 to 0.85.

8. An image-forming apparatus of claim 3, wherein an average primary particle size of the fine particles made from the resin having a frictional coefficient greater than that of the binder resin is greater than an average primary particle size of the fluorine-containing resin fine particles contained in the uppermost surface of the charge transporting layer.

9. An image-forming apparatus of claim 3, further comprising a cleaning blade to clean toner remaining on the photosensitive member and wherein the cleaning blade contains a lubricant.

10. An image-forming apparatus of claim 9, wherein the lubricant is one or more compounds selected from the group consisting of fluorine-containing resin fine particles, strontium titanate, and metal stearates.

11. An image-forming apparatus, comprising:

a photosensitive member comprising a charge transporting layer on a charge generating layer, the charge transporting layer having an uppermost-surface layer containing fluorine-containing resin fine particles, a binder resin and fine particles made from a resin having a frictional coefficient greater than the binder resin, wherein an average primary particle size of the fine particles made from the resin having a frictional coefficient greater than that of the binder resin is greater than an average primary particle size of the fluorine-containing resin fine particles;

a charging device to uniformly charge the surface of the photosensitive member;

an exposing device to expose the charged photosensitive member to form electrostatic latent images; and a developing device to develop the electrostatic latent images.

12. The image-forming apparatus of claim 11, further comprising a cleaning blade for cleaning toner remaining on the photosensitive member.

13. A method for forming an image, comprising:

charging a photosensitive member comprising a charge transporting layer on a charge generating layer, the charge transporting layer comprising plural layers and having an uppermost-surface layer containing fluorine-containing resin fine particles, wherein the uppermost layer further comprises a binder resin and fine particles made from a resin having a frictional coefficient greater than the binder resin;

exposing the charged photosensitive member to form electrostatic latent images; and developing the electrostatic latent images with a toner having a volume-average particle size of 2 to 5.5 $\mu$m, with a ratio of content of particles having a particle size of not more than 1 gm being set to not more than 1.0 volume %.

14. The method of claim 13, wherein the toner has 1.0 volume % or less in a rate of toner particles having a particle size of not less than 9 $\mu$m.

15. The method of claim 13, wherein the volume-average particle size of toner is 3 to 5 $\mu$m.

16. The method of claim 13, wherein the exposing is performed by an exposing device having a recording dot of not less than 400 dots/inch.

17. The method of claim 13, wherein an average primary particle size of the fine particles made from the resin having a frictional coefficient greater than that of the binder resin is greater than an average primary particle size of the fluorine-containing resin fine particles.

18. The method of claim 17, wherein the average primary particle size of the fine particles made from the resin having a frictional coefficient greater than that of the binder resin is 2 to 20 times greater than the average primary particle size of the fluorine-containing resin fine particles.

19. The method of claim 17, wherein the average primary particle size of the fine particles made from the resin having a frictional coefficient greater than that of the binder is 0.03 to 5 $\mu$m.

20. The method of claim 17, wherein the average primary particle size of the fluorine-containing resin fine particles is 0.01 to 2 $\mu$m.

21. The method of claim 17, further comprising rotating the photosensitive member at a speed of 300 mm/sec to 700 mm/sec.

* * * * *